US005509703A

United States Patent [19]

Lau et al.

[11] Patent Number: 5,509,703

[45] Date of Patent: Apr. 23, 1996

[54] ENCLOSURE LATCH

[75] Inventors: Robert G. Lau, Anoka; John S. Abbott, Plymouth; David A. Swan, Shoreview, all of Minn.

[73] Assignee: Federal-Hoffman, Inc., Anoka, Minn.

[21] Appl. No.: 512,778

[22] Filed: Aug. 9, 1995

Related U.S. Application Data

[63] Continuation of Ser. No. 184,673, Jan. 21, 1994, abandoned.

[51] Int. Cl.[6] ..... E05C 19/00

[52] U.S. Cl. ..... 292/1; 292/336.3

[58] Field of Search ..... 292/1, 22, 336.3

[56] References Cited

U.S. PATENT DOCUMENTS

| | | | |
|---|---|---|---|
| 2,733,089 | 1/1956 | Grevengoed | 292/1 |
| 3,110,512 | 11/1963 | Scalf et al. | 292/5 |
| 3,170,701 | 2/1965 | Hoover | 277/180 |
| 3,374,649 | 3/1968 | Weidman | 70/210 |
| 3,500,668 | 3/1970 | Henry | 292/336.3 |
| 3,510,182 | 5/1970 | Cowles | 277/184 |
| 4,311,317 | 1/1982 | Bartles | 277/212 C |
| 4,563,885 | 1/1986 | Madden | 70/210 |
| 4,616,864 | 10/1986 | Douglas | 292/336.3 |
| 5,123,683 | 6/1992 | Solovieff | 292/1 |
| 5,253,917 | 10/1993 | Brueggemann | 292/336.3 |
| 5,265,924 | 12/1993 | Kim | 292/347 |

FOREIGN PATENT DOCUMENTS

| | | |
|---|---|---|
| 0175211 | 3/1986 | European Pat. Off. . |
| 0446566 | 9/1991 | European Pat. Off. . |
| 0491133 | 6/1992 | European Pat. Off. . |
| 1493446 | 7/1967 | France . |
| 638049 | 11/1936 | Germany . |
| 730944 | 12/1942 | Germany . |
| 3445170 | 9/1985 | Germany . |
| 8625578 | 1/1988 | Germany . |
| 9104325 | 8/1992 | Germany . |
| 190669 | 7/1937 | Switzerland . |

*Primary Examiner*—Steven N. Meyers
*Assistant Examiner*—Monica E. Millner
*Attorney, Agent, or Firm*—Merchant, Gould, Smith, Edell, Welter & Schmidt

[57] ABSTRACT

A latch for securing a cover or door to an enclosure provides a dust and water tight seal. The latch has a housing in which an activator is rotatably mounted. The latch housing has a depression formed in one of its surfaces. A gasket is designed to fin in the depression providing a seal between the activator and the housing. In the preferred embodiment the latch is a quarter-turn latch. The rotation of the latch is limited between a locked and unlocked position substantially 90° apart.

17 Claims, 9 Drawing Sheets

ENCLOSURE LATCH

This is a Continuation of application Ser. No. 08/184,673, filed Jan. 21, 1994 now abandoned.

BACKGROUND OF THE INVENTION

1. Field of the Invention

The present invention relates to a latch apparatus which is utilized to secure a cover or door.

2. Description of the Prior Art

Various kinds of latches for securing lids, covers and doors are well-known. Latches are configured in numerous styles for a variety of applications.

For electrical enclosures, it is important that a dust and water-tight seal be formed between the cover and the enclosure to prevent dust and water from entering the enclosure and to prevent damaging components which are stored therein. It is important that the latch be able to tighten the cover against the enclosure by tightening the cover against the seal or gasket which is typically placed between the cover and the enclosure. In addition, it is important that the latch itself be air, dust and water-tight so that no leaks are formed through the latch.

Enclosures are placed in a variety of environments and mounted in a variety of configurations. In addition, numerous types of security may be needed for the enclosure. For example, the latch may be accessed by anyone, it may require a special tool to actuate, it may require a key, or may be padlocked. Since the latch may be mounted in any number of places, depending on the application, the latch should be rotatable in either direction to lock or unlock. In addition, since the degree of security needed varies from location to location, the same latch should also be able to adapt to a variety of handles, keylock or other types of locking mechanisms. Since the cover may have different configurations for being secured, for example, latching at one point or latching at several points, it is important that each latch be adaptable to a different latching means. In addition to different types of latching, a latch should be easily configured to adapt to different sizes of enclosures.

It can be seen then, that a new and improved latch is needed. Such a latch should provide a seal across the latch without allowing water, dust or air to enter. In addition, the latch should be able to securely retain the cover against an enclosure. Such latches should also be adaptable to configure to actuation in either direction, and to a variety of locking and handle configurations. The latch should also be able to actuate while retaining at one or more points. The present invention addresses these and other problems related to mechanical latches.

SUMMARY OF THE INVENTION

The present invention is directed to a latch apparatus which may be used to retain a cover or a lid on enclosures. The present invention is especially directed to a latch forming a seal which is both air and water tight so that there is no leakage into the enclosure.

The present latch includes a housing having a depression formed therein for receiving a gasket. The gasket includes several surfaces for sealing against the depression and a channel formed at the inside of the impression. A rotating activator extends through the housing and the gasket so that a seal is formed by the gasket against both the housing and the activator.

The present invention also provides for having an actuator which may be key actuated or actuated with a tool. In addition, various types of handles may be attached to the actuator so that various types of security can be accommodated. In addition to a handle inserting and attaching to the actuator, a handle which may be locked with a key or padlock may also be utilized.

The present invention also provides for various types of retaining members and systems which may be accommodated with the same latch and different handles. The first retainer is limited to one quarter turn and rotation and is reversible so that it may be utilized for rotation in either direction and also may be utilized so that it may be rotated in two different positions. A further embodiment includes a rack and pinion system with a gear formed on the retainer or mounted to the retainer member. The gear engages rack members which may include extensions to provide closure at the latch point as well as side points of a lid or cover. Extension members may be varied in length so that the system may be used with various sizes of covers.

The present latch provides a sealed latch which is adaptable to various types of handles and various types of retaining members and a variety of cover sizes.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding elements throughout the several views.

DETAILED DESCRIPTION OF THE PREFERRED EMBODIMENT(S)

Figure 1:
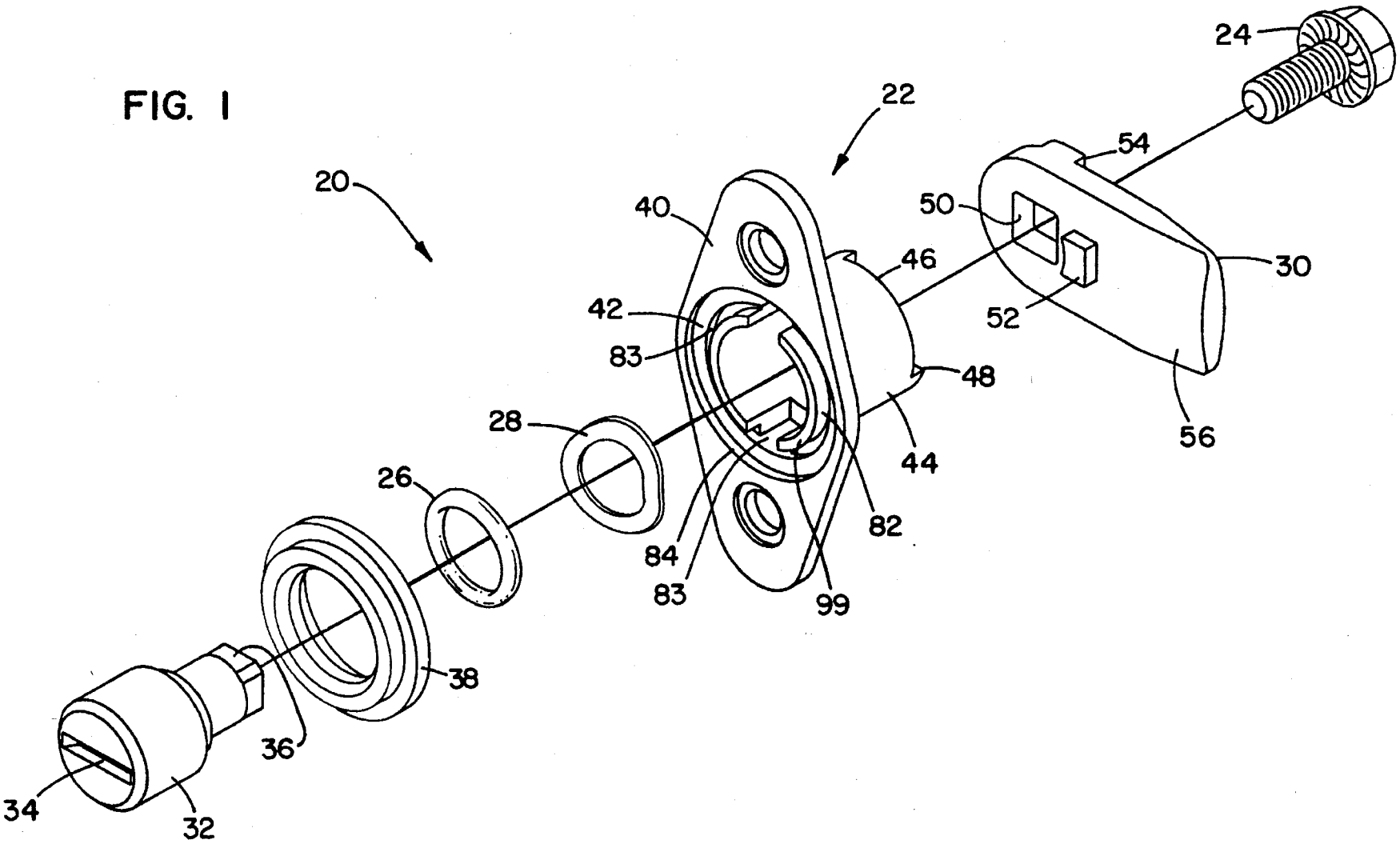
FIG. 1 shows an exploded view of a latch according to the principles of the present invention.

Referring now to the drawings, wherein like reference numerals designate corresponding structure throughout the views, and referring in particular to FIG. 1, there is shown a latch, generally designated 20. The latch includes a housing 22 having a planar mounting portion 40, and a cylindrical barrel portion 44 extending therefrom. The mounting portion 40 includes a depression 42 formed therein having an inner ring 82 extending slightly upward through the depression 42. The inner ring 82 forms inner side portions to the depression 42 for engaging a gasket, as explained hereinafter. A ridge 83 forms a deeper depression proximate the inner ring 82. The planar mounting portion 40 also may include a pair of orifices or other mounting structures. At an opposite end of the barrel portion 44 are formed slots 46 extending approximately around one quarter of the circumference of the barrel 44. The slot 46 has squared end portions 48 for engaging a retainer cam 30 as explained hereinafter. An actuator 32 extends through a gasket 38 fitting into the depression 42 in the mounting portion 40, as explained hereinafter. In addition, an inner gasket 26 and a spring washer 28 extend down through a portion of the barrel. The actuator 32 includes a slot 34 or other portion which can be gripped by a screwdriver or other device. In addition, the actuator 32 includes a squared end portion 36 which extends through a square orifice 50 in the cam 30.

Figure 5:
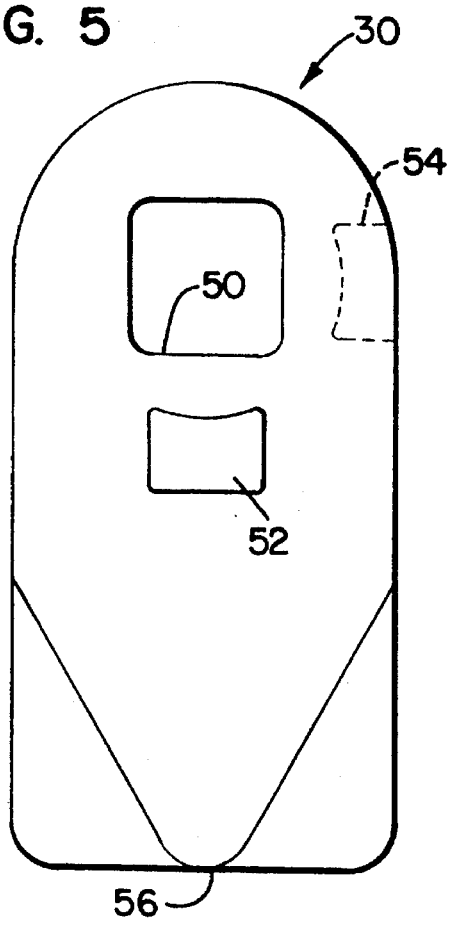
FIG. 5 shows a top plan view of the cam of the latch shown in FIG. 1.
Figure 6:
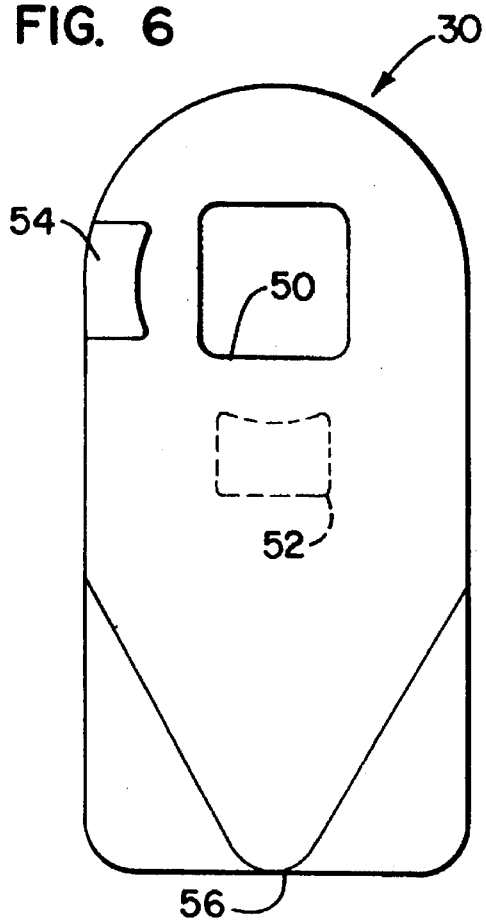
FIG. 6 shows a bottom plan view of the cam shown in FIG. 5.
Figure 4:
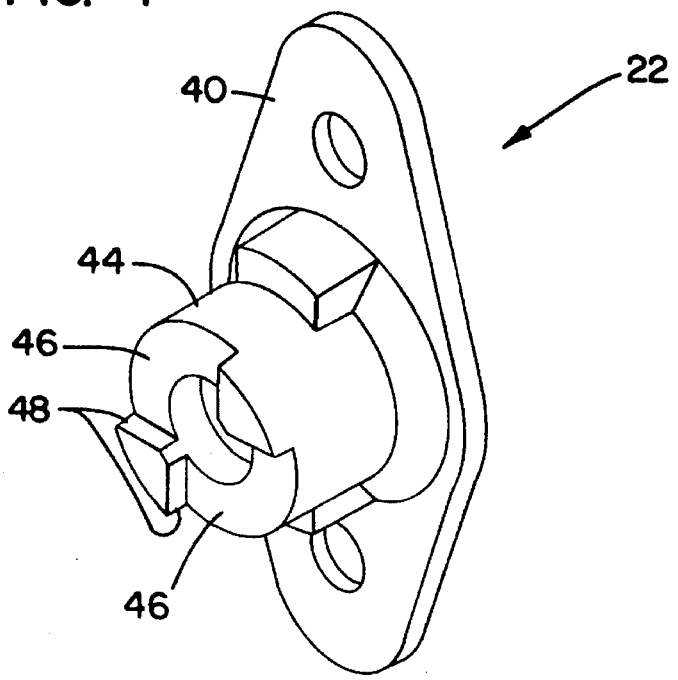
FIG. 4 shows a prospective view of the bottom portion of the housing for the latch shown in FIG. 1.
Figure 9:
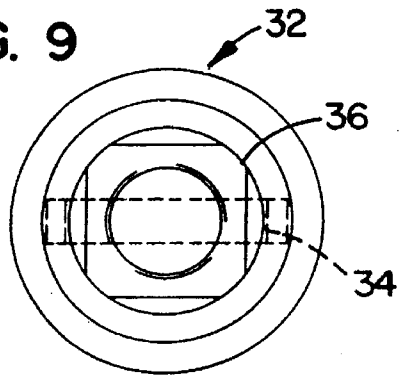
FIG. 9 shows a bottom plan view of the actuator shown in FIG. 7.
Figure 8:
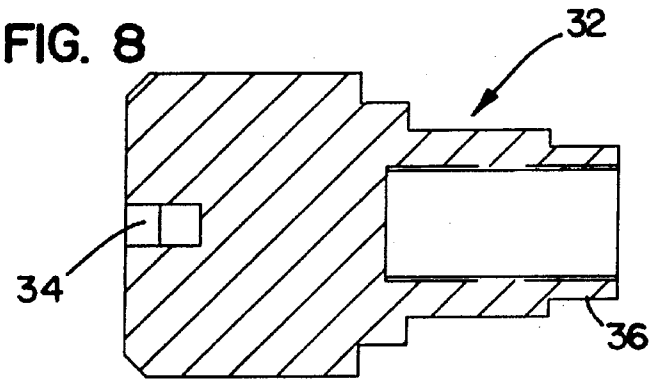
FIG. 8 shows a side sectional view of the actuator shown in FIG. 7.
Figure 7:
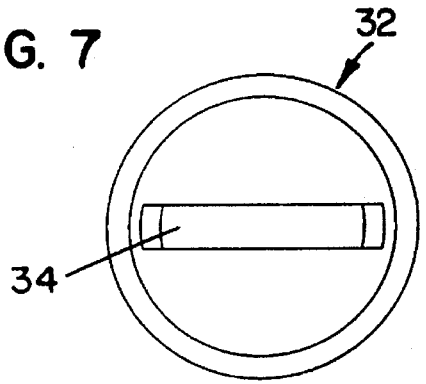
FIG. 7 shows a top plan view of the actuator for the latch shown in FIG. 1.
Figure 10:
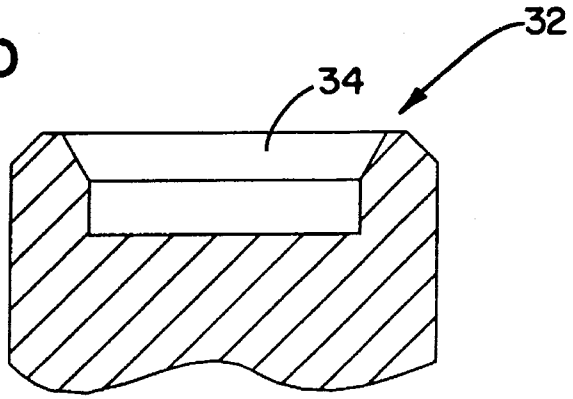
FIG. 10 shows a partial sectional view of the actuator shown in FIG. 7.

As shown in FIGS. 4–6, the cam 30 is limited by the slots 46 and the barrel portion 44 of the housing 22 to rotation of only one quarter turn. When assembled in the position shown in FIG. 1, block 52 nearer the lip 56 of the cam 30 extends into one of the slots 46. It can be appreciated that if the block 52 is in the slot 46, the latch is limited to a range of motion of one quarter turn. However, if the cam 30 is reversed in orientation, the block 54 will engage the slot 46. Again the range of motion will be limited to one quarter turn, but since the block 54 is situated to the side of the square orifice 50 rather than toward the lip portion 56, the range of motion will be rotated by 90 degrees. Furthermore, since the block 52 or 54 may be placed in either of the two slots 46 formed in the barrel portion 44, the range of motion may be offset by 180 degrees from the other of the slots 46. In this manner, the cam 30 may be placed so that it may be rotated in four different ways to engage or disengage a complimentary portion of a cover or housing. This provides for a latch 20 which can adapt to a number of configurations for locking or unlocking without having to interchange parts.

Figure 13:
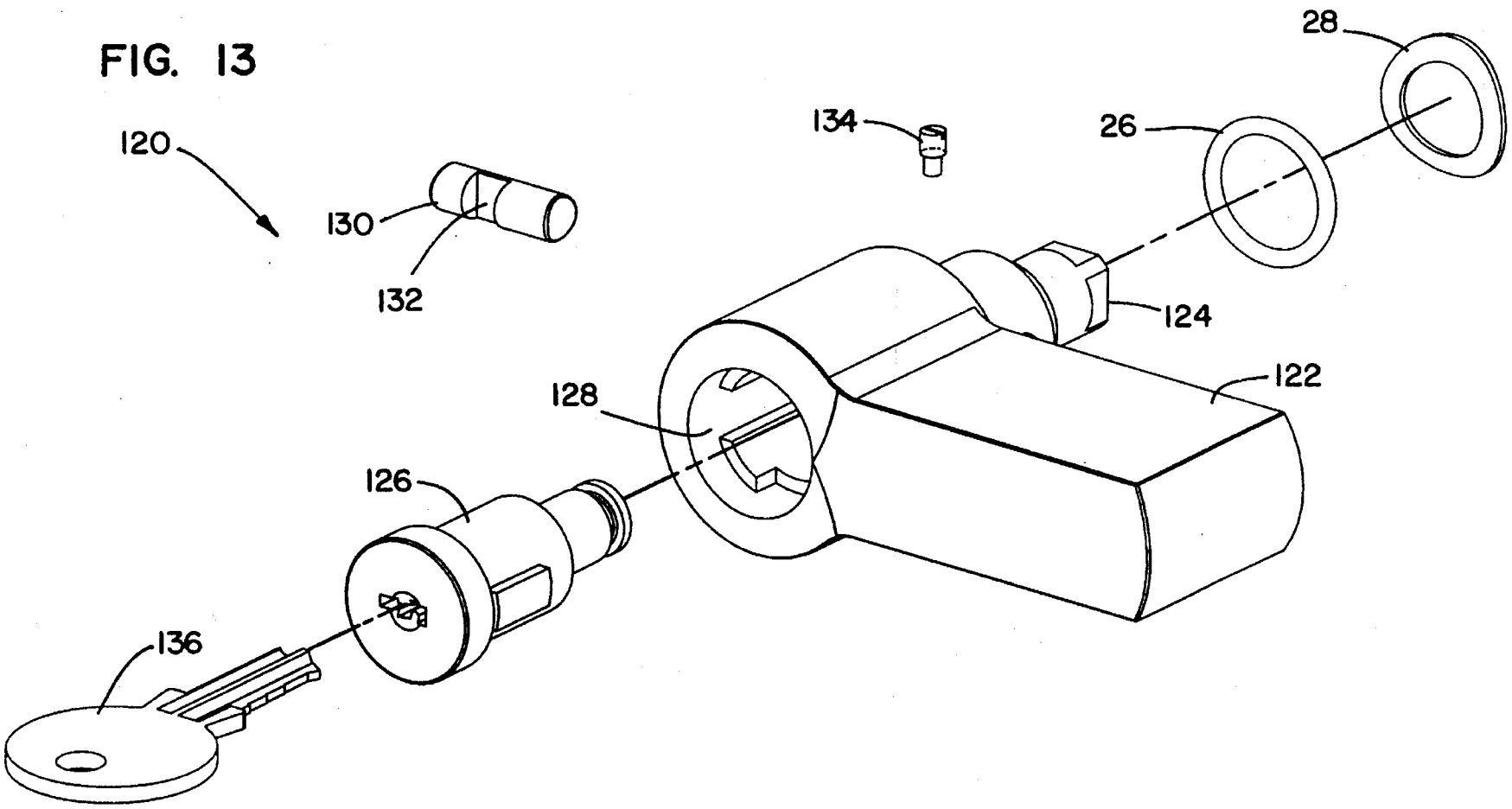
FIG. 13 shows an exploded view of a key actuated handle for the latch shown in FIG. 1 or FIG. 2.

In addition to the different latching configurations, a number of different handles may be utilized. In addition to the slotted configuration shown in FIG. 1 and shown in greater detail in FIGS. 7–10, a number of handles may also be added to an actuator. As shown in FIG. 13, handle 120 shown which may be utilized with the latch shown in FIG. 1 or FIG. 2. The handle 120 includes a grip portion 122 extending from a barrel portion 128. The key locking cylinder 126 extends thereto to lock or unlock the handle. An actuator 124 extends from the barrel portion to engage the latch as explained above. The keylock cylinder 126 engages a small transversely mounted cylinder 130 having a notch 132 formed therein. A key 136 inserts into the cylinder 126 to turn the cylinder between a locked position engaging the cylinder 130 in an unlocked position. In the unlocked position cylinder 130 is retracted from slots in housing 122. The transversely mounted cylinder 130 is held in place by cylinder 126. Cylinder 126 is held in place by set screw 134, but is allowed to rotate. When unlocked, the latch may be rotated by gripping the handle 120 and turning it one quarter turn. It will be appreciated that the handle 120 may also include a different type of cylinder which may be actuated with a screwdriver or other tool rather than a key.

Figure 14:
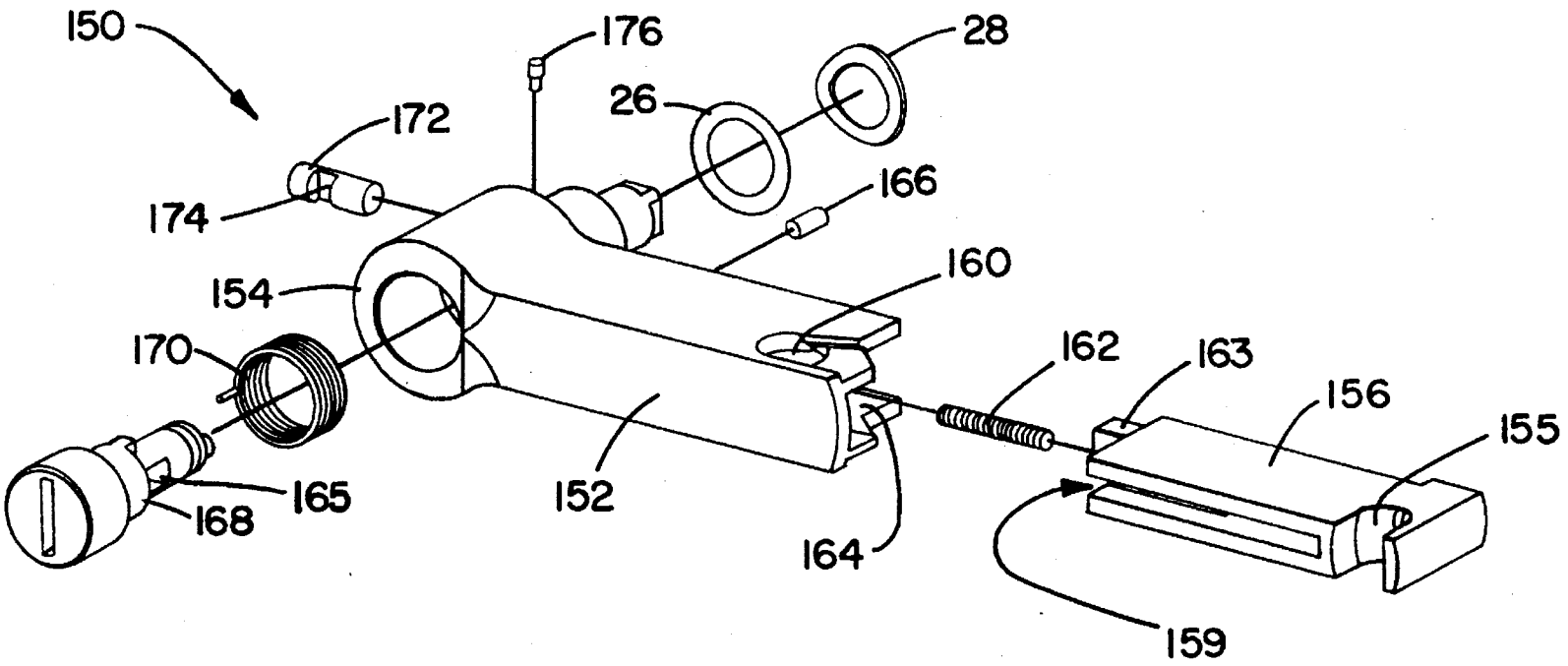
FIG. 14 shows an exploded view of a handle lockable with a padlock for the latch shown in FIG. 1 or FIG. 2.

As shown in FIG. 14, a handle 150 may be configured for being locked with a padlock. The handle 150 includes a grip portion 152 extending from the barrel portion 154. Within grip portion 152 is an insert 156 which slides inside of the grip portion 152. The insert portion 156 includes a notch 155 which is aligned with an orifice 160 in the grip portion 152. When these are aligned, a padlock shank may be inserted therethrough to maintain the handle 150 in a locked position. The insert portion 156 includes a hole 159 receiving a spring 162. The spring 162 biases the insert portion 156 toward the unlocked position. The insert portion slides in the channel 164 formed in the handle portion. The stop 166 limits movement of the handle portion insert 156 during slide within the channel 164. An actuator insert 168 inserts into a helical torsion spring 170 into the barrel portion 154. A locking cylinder 172 runs transversely into the barrel portion 154 and includes a notch 174. The activator insert 168 is held in place by set screw 176, but may rotate. The locking cylinder is retained by the engagement of insert 168 into notch 174. When the handle insert 156 is in the locked position, a locking tab 163 prevents the actuator insert 168 from rotation by engaging the notch 165. However, when the insert 156 is slid outward, the locking tab 163 does not engage the notch 165 and the activator insert 168 may be rotated to disengage cylinder 172 from the slots on housing 20. When the insert 156 is released, the spring 162 forces the sliding insert 156 outward and back to the unlocked position. When insert 156 is pushed inward to the locking position, the holes are aligned, and a padlock shank may be inserted through the notch 155 and orifice 160 to maintain the insert 156 in a locked position and prevent activator insert 168 from being rotated which would unlock the handle.

Figure 12:
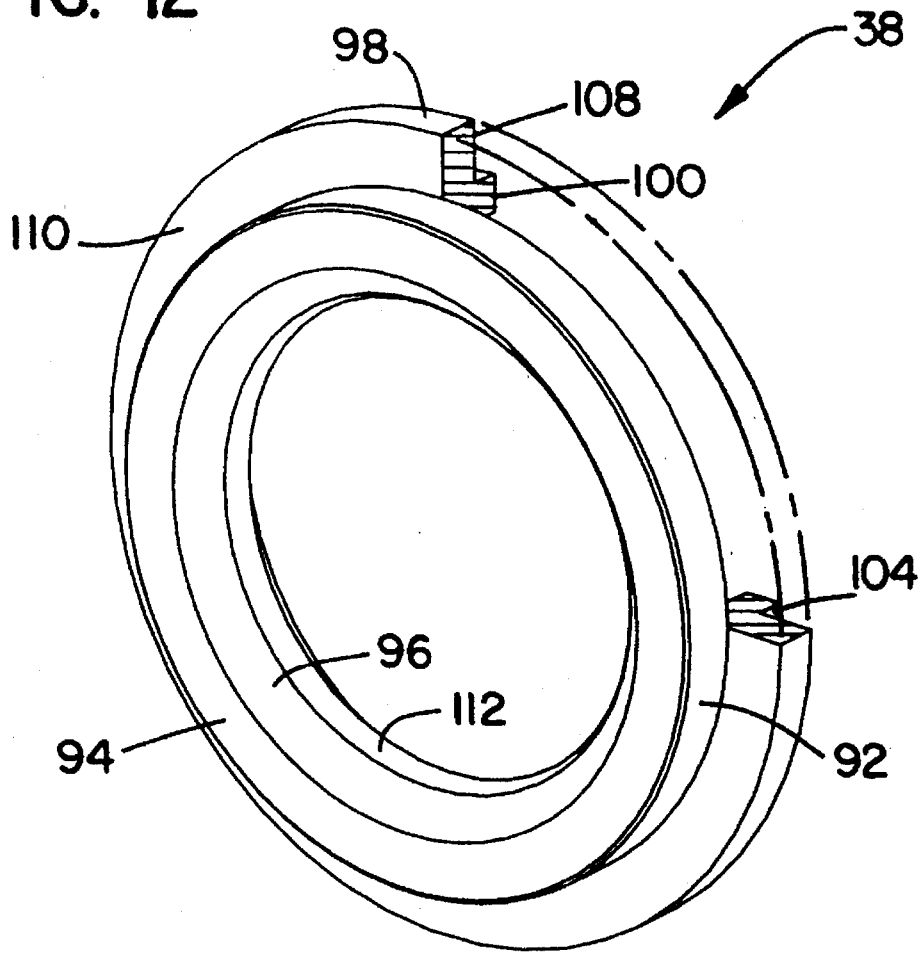
FIG. 12 shows a prospective partially broken away view of the gasket shown in FIG. 11.
Figure 11:
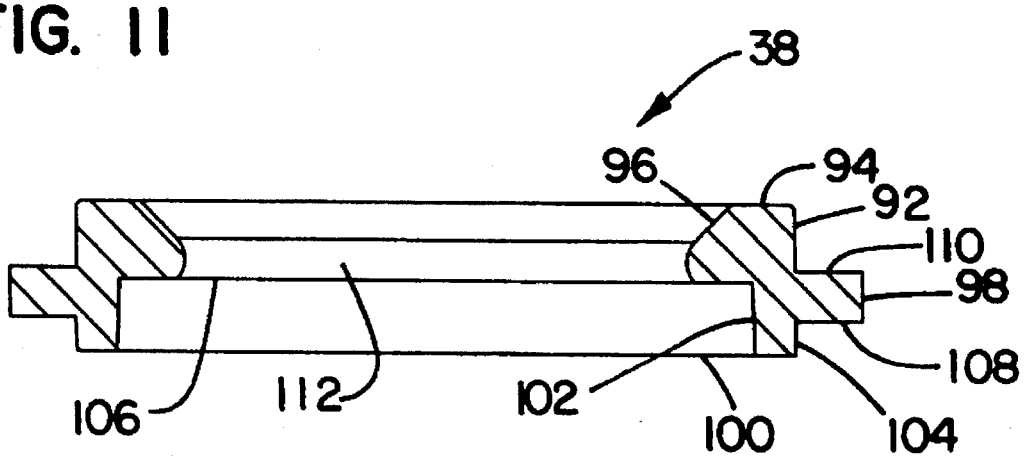
FIG. 11 shows a side partial section view of a gasket for the latch shown in FIG. 1.

As shown in FIGS. 11 and 12, the gasket 38 for the latch 20, is configured to seal against several surfaces. The gasket 38 is configured to insert into the depression 42 in the mounting portion 40 shown in FIG. 1. In a similar fashion, gasket 38 fits into an alternative embodiment of a housing 62 of FIG. 2. When inserted, a lower rim 100 inserts into the inner ring of the depression 42. An outer edge 104 butts the inner side of the barrel portion 84 while an inner edge 102 engages the inner ring 82. A lower edge of the inner portion 106, rests on top 99 of the rings 82. In addition, a lower edge 108 of an outer ring 110 rests against the depression surface 42 while an outer edge 98 engages the side of the depression 84. The top portion lies substantially flush with the top surface of the cover or intended mounting surface. An inner edge 112 seals against an outer surface of an actuator 32. In addition, an outer edge 92 of the upper ring 94 can engage an opening of the cover or other surface which the latch 20 is mounted to. A bevel portion 96 extends from a top 94 of the gasket 38 into the inner edge 112 and allows for easier insertion. It is appreciated that with the multiple edges, the gasket 38 provides sealing against ten surfaces, thereby providing a water tight latch and lock assembly. It can also be appreciated that the gasket 38 may be used with the numerous different configurations of the latch.

Figure 2:
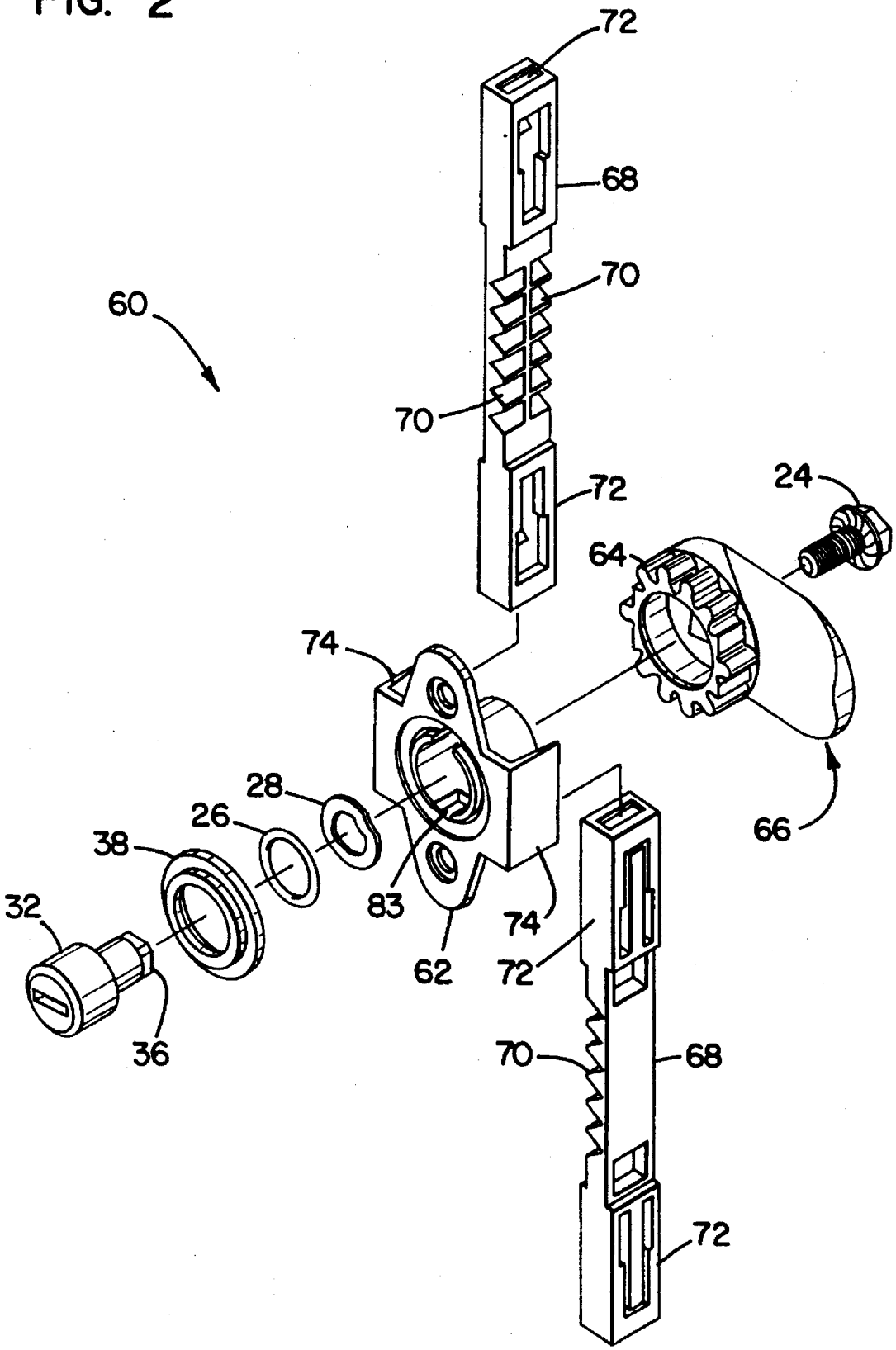
FIG. 2 shows a prospective view of an alternate embodiment of a latch according to the principles of the present invention.
Figure 15:
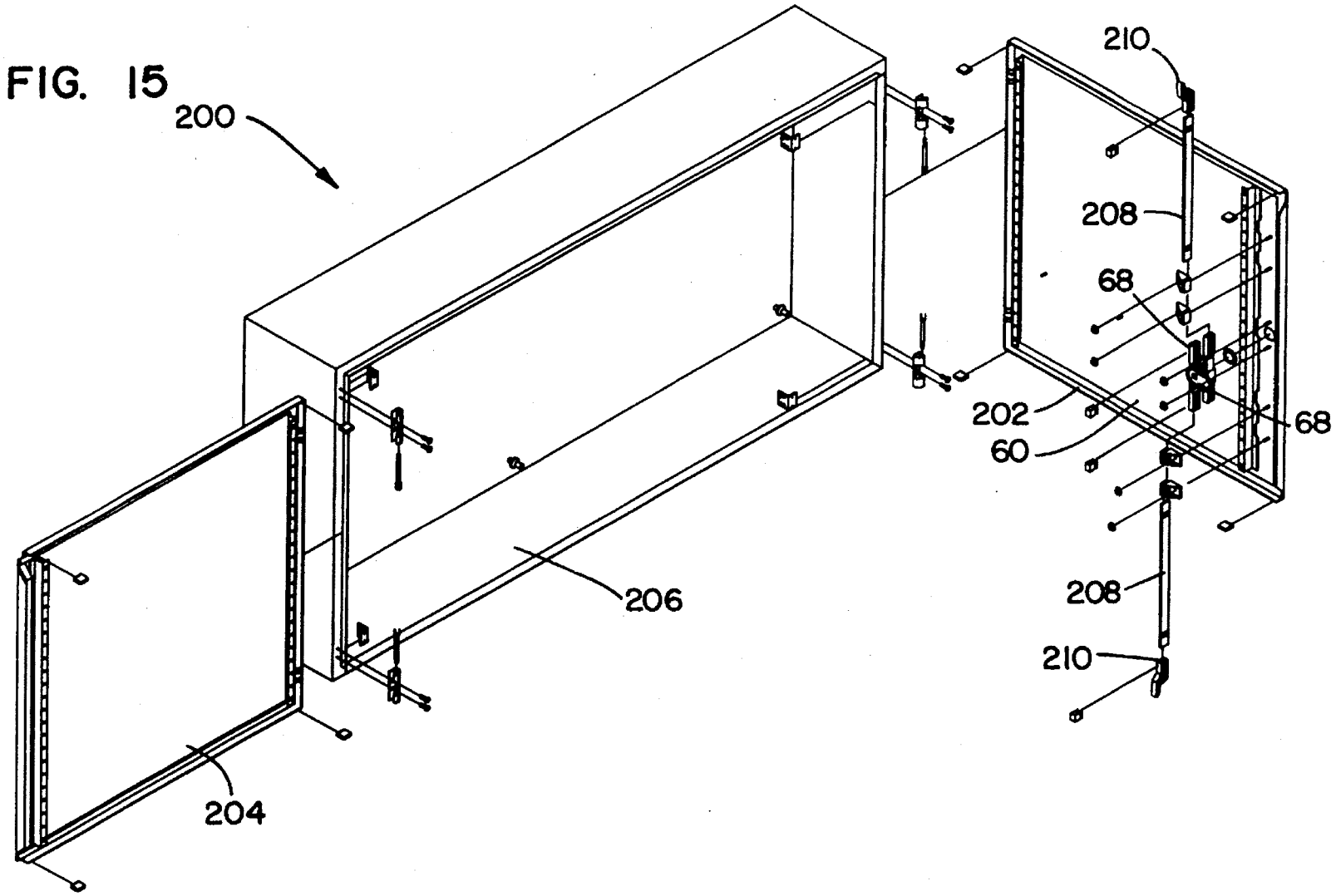
FIG. 15 shows a prospective view of an enclosure utilizing the latch shown in FIG. 2.

An alternate embodiment of a latch 60 is shown in FIG. 2 which may be used with an enclosure shown in FIG. 15.

Figure 3:
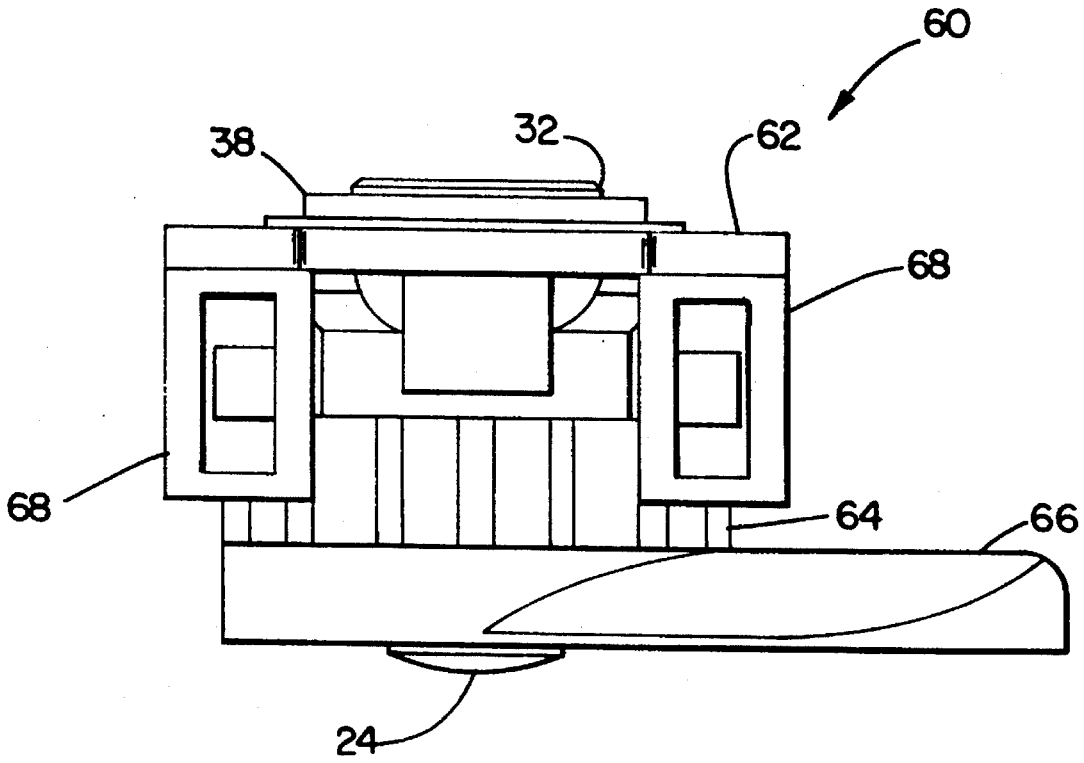
FIG. 3 shows an end view of the latch shown in FIG. 2.

The enclosure 200 includes a main housing portion 206 and doors 202 and 204. The latch 60 mounts to one of the doors 202 or 204. Rack members 68 attach to extension members 208 to provide for a latching along the top and bottom of the door 202. The end of the extension members are retainer members 210 which lock the door 202 when closed. When the latch 60 is turned to a first position, retainer members 210 are withdrawn with the rack members 68 so that the door may be easily opened or closed. In the second position, the retainer members 210 extend and the doors 202 and 204 are securely latched. As shown in FIG. 2, the latch 60 includes a housing 62 similar to the housing shown in FIG. 1, but including side retaining members 74. A cam member 66 includes a pinion gear 64 formed thereon for engaging the rack member 68. The rack members 68 include extension mounting portion 72 and a rack of teeth 70 for engaging the pinion gear 64. As shown in FIG. 3 when assembled, the rack members 68 are inside of the retaining member 74 and engaging the teeth of the pinion gear 64.

As the actuator 32 is rotated, the pinion gear 64 also rotates. This actuates the rack members 68 to either extend or retract. It can be appreciated that the rack members 68 include extender mounting members 72 at both ends so that it may be easily adaptable to latching when rotated in either a clockwise or counter clockwise direction. By varying the length of the extender members 208, the latch and retainers may be used with doors of different heights.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A quarter turn latch, comprising:

(a) a latch housing;

(b) an insert rotatably mounted in the housing;

(c) a cam member mounted to the insert;

(d) a gear attached to the insert;

(e) a pair of rack members disposed on either radial side of the gear and extending in opposite directions slidably mounted to the housing, wherein each of the rack members includes a plurality of teeth interacting with the gear, and wherein rotating the gear in a first direction retracts the rack members and rotating the gear in a second direction extends the rack members; and, (f) a gasket mounted on the housing around the insert and forming a seal between the insert and the housing.

2. A latch according to claim 1, wherein the rack members are reversible and interchangeable.

3. A quarter turn latch, comprising:

(a) a housing;

(b) an insert rotating about an axis in the housing;

(c) a cam member reversibly connected to the insert, wherein in a first mounting position, a first cam surface faces a first axial direction, and when reversed, the first cam surface faces an opposite axial direction; and, (d) rotation limiting means for limiting rotation of the cam, wherein in the first mounting position, the latch rotates in a first direction between a latched position and an unlatched position, and in the reversed mounting position, the latch rotates in a second direction between a latched position and an unlatched position.

4. A latch according to claim 3, wherein the cam member is rotated approximately 90 degrees between the first and reversed mounting positions.

5. A latch according to claim 3, wherein the cam member comprises a raised portion extending axially on a first face and a second raised portion extending axially on a reverse face, wherein the raised portion on the first face is offset about 90 degrees from the raised portion on the reverse face.

6. A quarter turn latch, comprising:

(a) latch housing having an upper surface with a depression formed therein, having an outer wall and an inner wall with an annular channel formed proximate the inner wall;

(b) insert disposed in the housing and rotating relative to the housing;

(c) a retaining member;

(d) an annular gasket including an upper ring portion and a lower ring portion and an intermediate ring extending radially beyond the upper and lower ring portions; wherein the intermediate ring extends radially outward beyond the upper and lower ring portions; wherein the lower ring portion inserts into the channel and the intermediate ring portion forms a seal with the outer wall; and wherein an inner surface of the ring portions seals with the insert.

7. A quarter turn latch, comprising:

(a) a latch housing;

(b) rotating insert actuator;

(c) a handle connected to the actuator and extending radially outward therefrom;

(d) a retaining member connected to the actuator;

(e) rotation limiting means for preventing rotation of the latch in a first position and providing for rotation of the latch in a second position wherein the rotation limiting means comprises a sliding member engaging the actuator in a first position to prevent rotation and disengages the actuator in a second position, and wherein the sliding member is disposed in the handle and slides longitudinally within the handle, and wherein the handle includes an orifice formed therethrough and the sliding member includes an orifice formed therethrough, and wherein the orifice in the sliding member aligns with the orifice in the handle in the first position; and, (f) restricting means for restricting rotation of the handle to within a predetermined range of motion.

8. A latch according to claim 7, wherein the actuator includes a slot formed therein, and wherein the sliding member engages the slot in a first position to prevent rotation and disengages the slot in a second position.

9. A latch according to claim 7, further comprising biasing means for biasing the sliding member toward the unengaged second position.

10. A latch according to claim 9,further comprising second biasing means for normally biasing the actuator toward a closed position.

11. A latch system comprising an insert rotatable about an axis;

a gasket forming a seal around the insert;

a first housing interchangeable with a second housing; wherein the first housing and second housing include a top surface with a depression formed therein for receiving the gasket and forming a seal with the gasket, and wherein the second housing includes a pair of side members extending parallel to the axis on angularly opposite sides of the axis;

interchangeable retainer members attaching to the insert, wherein a first retainer member defines a cam member and a second retainer member includes a cam member and a gear engaging rack members inserting intermediate the side members and the insert.

12. A latch according to claim 5, wherein the cam member further comprises a retaining member extending radially outward.

13. A latch according to claim 1, wherein the gear is angularly reversibly mounted in the housing to provide for actuation in clockwise or counterclockwise directions.

14. A latch according to claim 7, wherein the latch mounts on an outer surface of a door.

15. A latch according to claim 3, wherein the cam member is angularly reversible for mounting in four positions, spaced 90 degrees angularly about the insert.

16. A latch according to claim 5, wherein the housing includes an annular end portion defining a recessed portion, and wherein the rotation limiting means comprises the annular end portion engaging the raised portion of the cam member.

17. A quarter turn latch, comprising:

(a) a latch housing;

(b) an insert rotatably mounted in the housing;

(c) a cam member mounted to the insert;

(d) a gear attached to the insert;

(e) a pair of rack members disposed on either radial side of the gear and extending in opposite directions slidably mounted to the housing, wherein each of the rack members includes a plurality of teeth interacting with the gear, and wherein rotating the gear in a first direction retracts the rack members and rotating the gear in a second direction extends the rack members.

* * * * *